United States Patent [19]

Koch et al.

[11] Patent Number: 4,981,168

[45] Date of Patent: Jan. 1, 1991

[54] MANDREL HOLDS EXPENDABLE CORE IN CASTING DIE

[75] Inventors: Byron W. Koch; Robert I. Badenhope, both of Toledo, Ohio

[73] Assignee: Farley, Inc., Chicago, Ill.

[21] Appl. No.: 378,315

[22] Filed: Jul. 11, 1989

[51] Int. Cl.[5] ..... B22D 33/04

[52] U.S. Cl. ..... 164/137; 164/132; 164/339; 164/340; 164/369

[58] Field of Search ..... 164/132, 137, 339, 340, 164/342, 344, 302, 369, 370, 346

[56] References Cited

U.S. PATENT DOCUMENTS

| | | | |
|---|---|---|---|
| 2,452,855 | 11/1948 | Kempf et al. | 22/131 |
| 3,028,643 | 4/1962 | Wedlake | 22/165 |
| 3,137,904 | 6/1964 | Steinman | 164/342 |
| 4,077,458 | 3/1978 | Hayashi et al. | 164/11 |
| 4,757,857 | 7/1988 | Henkel | 164/339 |

FOREIGN PATENT DOCUMENTS

| | | | |
|---|---|---|---|
| 39-2205 | 3/1964 | Japan | 164/137 |
| 55-28780 | 7/1980 | Japan | 164/132 |
| 61-180664 | 8/1986 | Japan | 164/137 |

*Primary Examiner*—Richard K. Seidel
*Assistant Examiner*—Rex E. Pelto
*Attorney, Agent, or Firm*—Hugh Adam Kirk

[57] ABSTRACT

This disclosure concerns a casting die for a cylinder, including engine blocks having a plurality of cylinders such as for internal combustion engines, including an expendable core for forming a jacket around the cylinders. This core has a printout portion at one end of the cylinder which is held in place by a cooperating flange on a mandrel that fits inside the cylinder. This mandrel may hold a liner for the cylinder. A dowel is provided in one of the die parts for insertion into the hollow mandrel. The mandrel is held in position by being clamped between the two opposing die parts, and the flanges of the core printout portion may be loosely held in the printout cavity of one of the die parts which preferably also contains one or more locating pins for bridging at least part of the gap between the printout portion and the printout cavity in the die for better positioning the core in the die. The core and mandrel may be assembled outside the die before being placed on the dowel, and after the casting is made, the mandrel and core are removed with it and then separated so the mandrel can be reused. For forming plural cylinders in an engine block, a secondary mandrel frame may be employed for further supporting the separate mandrels for each cylinder and the plural cylinder expendable core by holding the flanged printout portion of the core between the flanges on the separate mandrels and the secondary mandrel frame. In casting the plural cylinders of a V-engine block, retractable dowels permit the employment of die parts and slides that move only at right angles to each other.

15 Claims, 5 Drawing Sheets

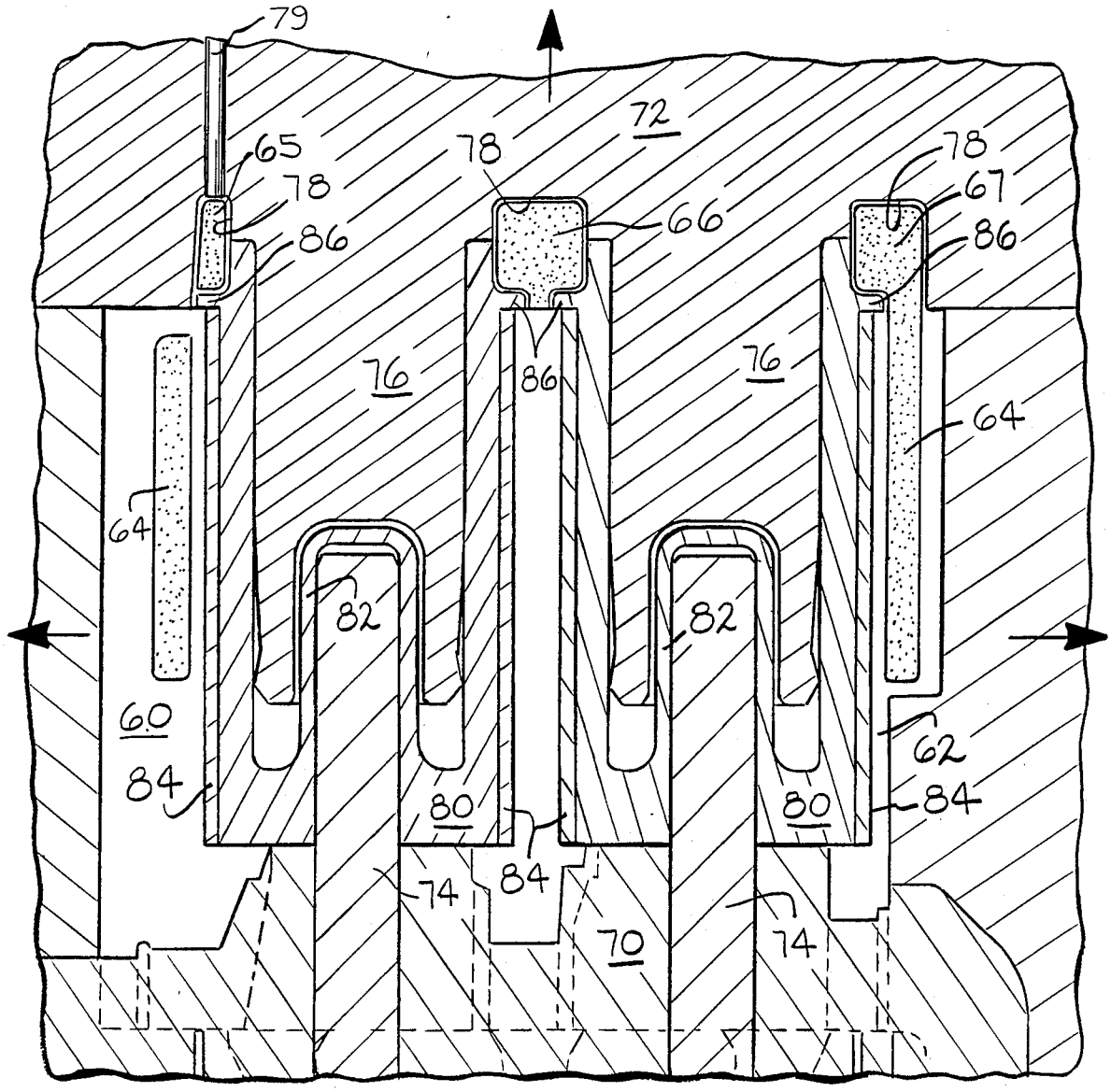
FIG. II

FIG. III
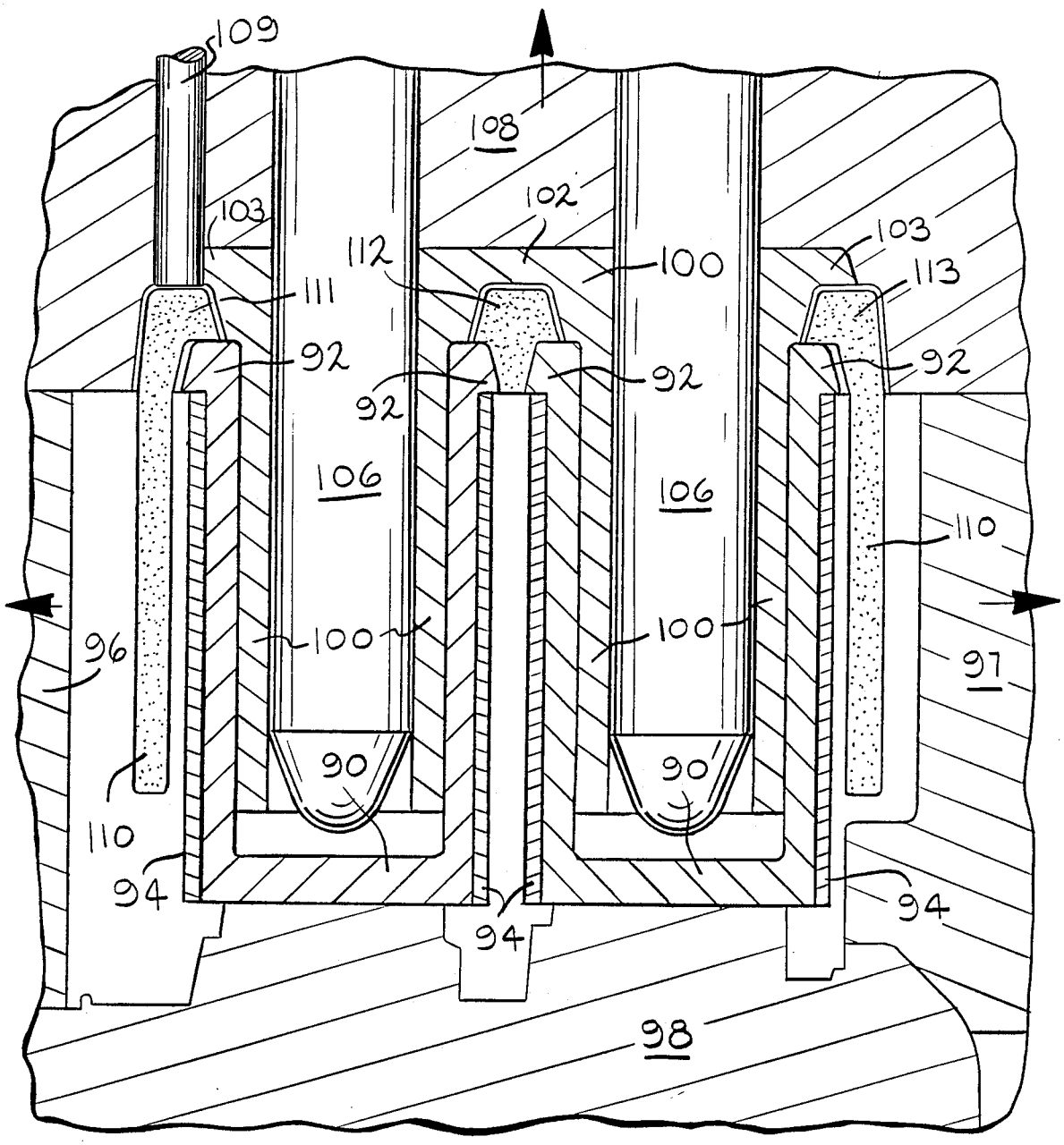

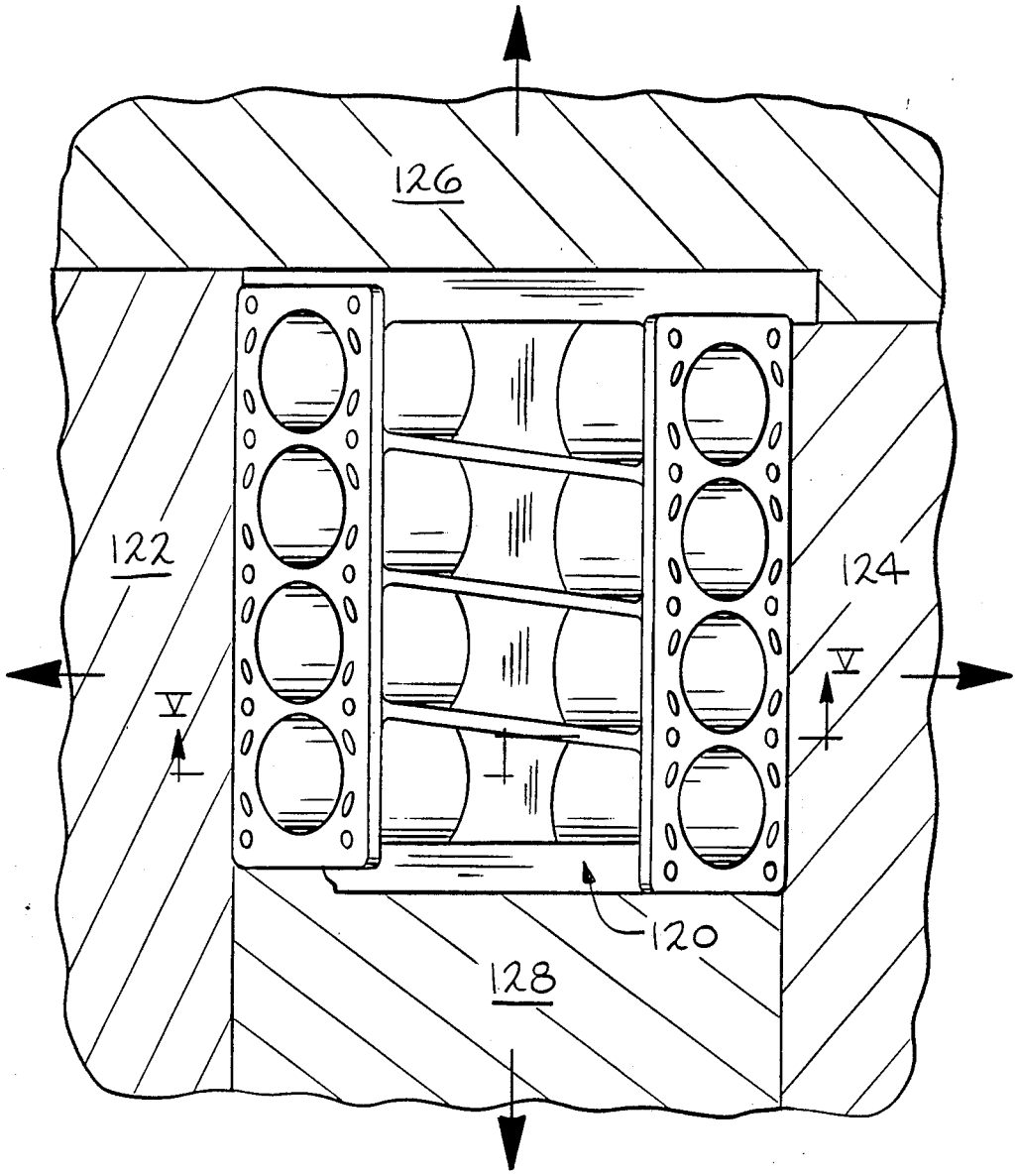
FIG. IV

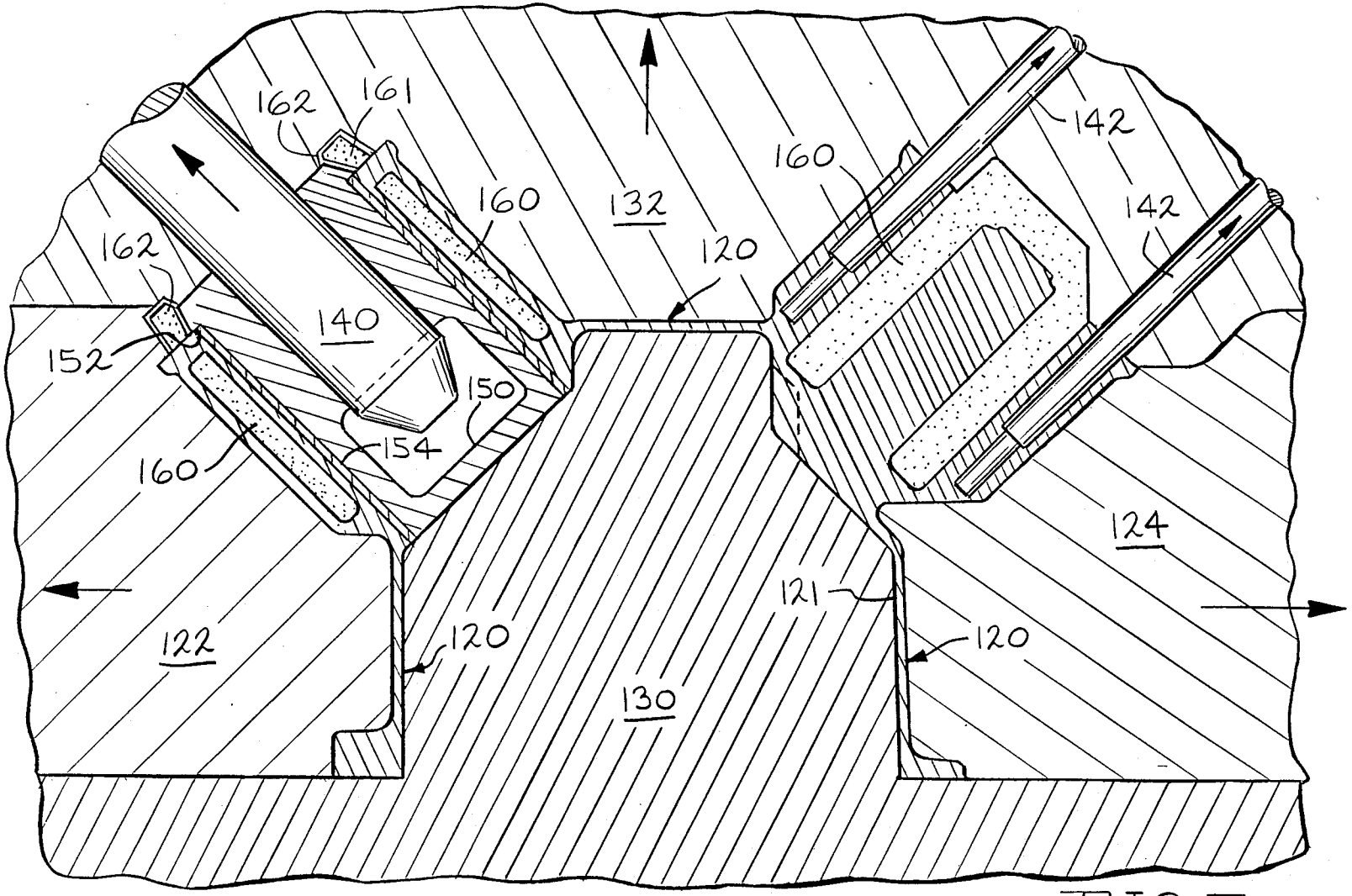
FIG. V

MANDREL HOLDS EXPENDABLE CORE IN CASTING DIE

RELATED APPLICATIONS

This application is related to applicants' U.S. Pat. No. 4,942,917 dated July, 24, 1990 directed to the expendable core employed with the die and mandrel of the present application. Another U.S. Pat. No. 4,913,217 dated Apr. 3, 1990 which discloses locating pins for the expendable core also employed with the die and mandrel of the present application. All of these applications are assigned to the same assignee.

BACKGROUND OF THE INVENTION

Previously molds for forming engine blocks with expendable cores for forming jackets around the cylinders are known. These cores, however, were primarily held by printouts extending from their cylindrical outer surfaces. Also the dies for forming such engine blocks included dowels mounted on the dies for forming the inside of the cylinders and for mounting liners for the cylinders. In casting V-engine blocks, complicated angularly mounted die parts which moved axially of the centerlines of the cylinders were also required for removal of the dowels from the cylinders in the blocks. Thus V-engine block castings required a minimum of six and usually eight relatively movable die parts.

SUMMARY OF THE INVENTION

Generally speaking, this invention relates to a pressure or gravity casting die for forming cylinders with hollow jackets around them, such as the cooling water jacket for the cylinders in an internal combustion engine block, which block may contain one or more cylinders or even be a V-engine block. This casting die comprises a pair of relatively movable dies which may be horizontal or vertical in their movement for forming the opposite axial ends of the cylinders in the block, such as the head of the cylinder and the crankcase. In addition to these two movable dies, there also is provided at least two oppositely movable slides for forming the opposite sides of the cylinders. In addition, there may be one or a pair of oppositely movable slides orthogonal to said two movable slides for forming the two ends of the block. In the case of a V-block, one of the dies at the end of the cylinders, i.e. the cover or ejector die, supports axially retractable dowels for supporting the mandrels for forming the inside of the cylinders. Thus in forming an engine block of one or a plurality of cylinders, including V-engine blocks, only four relatively movable die parts are required, and a maximum of six die parts, all of which move relatively only in-line or orthogonally to each other.

Over these dowels, usually in the ejector die, are hollow flanged mandrels or sleeves upon the outside of which may be mounted the liners for the inside of the cylinders. The flanges extend outwardly at the outer ends of the mandrels for engagement with inwardly extending flanges mounted on the printout portions at one end of the substantially hollow cylindrical expendable cores. These cores surround the cylinders in the block and are employed for forming hollow jackets spaced from and surrounding the cylinders, such as the water cooling jackets of internal combustion engines. When the die is closed, the flange and the opposite end of the mandrel are clamped between opposite die parts. However, there may be a slight gap or space between the printout portion of the expendable core and the corresponding printout cavity in the die part for receiving the printout portion. This space allows the core to float and prevents it from being broken by the closing of the die. In order to reduce this floating and to position better the core in the die, there may be provided a plurality of locating pins in the adjacent die part for bridging at least part of this space or gap between the printout portion and its receiving cavity in the die. Some such locating pins are described and shown in applicants' U.S. Pat. No. 4,913,217 previously mentioned. Thus the only support for the expendable core is by the printout portion at the end of the cylindrical core, which printout portion is held in place between the flange on the mandrel and its receiving cavity in the die.

If desired in an engine block having a plurality of aligned cylinders, a secondary outwardly flanged mandrel frame or group mandrel may be provided which bridges the space between the separate cylinders and clamps the inwardly extending flange on the printout portion of each of the aligned cylinders between the two outwardly extending flanges on the two mandrels for each cylinder. This second mandrel frame adds to the rigidity of the whole mandrel and expendable core assembly, which assembly of separate mandrels and one core otherwise would be supported only by the expendable core before placement in the die.

Thus the mandrels usually are assembled with the core prior to placing the mandrels on the dowels in the die. Similarly after the casting is made, the mandrels are removed with the casting together with the core, and the mandrels are separated from the casting and reused. The expendable core having been disintegrated by the heat of the molten metal in making the die casting, its remains are shaken out of the casting after the mandrels have been removed. Thus the method of assembling and disassembling of the core and mandrels in the die for forming the cylinder blocks is an important additional feature of this invention.

OBJECTS AND ADVANTAGES

It is an object of this invention to produce a simple, efficient, effective and economic casting die with an expendable core for forming cylinder blocks with a hollow water jacket around the cylinders, such as in the mass production of die cast cylinder engine blocks for internal combustion engines.

Another objects is to produce such a casting die including mandrels for each cylinder for supporting the liners for the cylinders, as well as supporting the printout portions of the expendable core which forms undercut regions or the water jacket around the cylinders.

Another object is to produce such a die casting die in which the movable parts only move at right angles or in line with each other and the number of movable parts is reduced from that previously required in die casting dies for V-engine blocks.

Still another object is to produce such die casting dies for engine cylinder blocks which require less maintenance than previous die casting dies for cylinder engine blocks and which dies are easier to manufacture and in which the cores are better located.

Another object is to produce a mandrel frame for supporting the individual mandrels for each cylinder and an expendable core as an assembly before being placed in a die.

BRIEF DESCRIPTION OF THE VIEWS

The above mentioned and other features, objects and advantages and a manner of attaining them are described more specifically below by reference to embodiments of this invention shown in the accompanying drawings wherein:

FIG. I is a sectional view through closed die casting die for forming a cylinder in a block with the expendable core held therein by a flanged mandrel according to an embodiment of this invention, which mandrel fits inside the cylinder and is mounted on a dowel supported by one of the die parts, which expendable core forms an undercut jacket around the cylinder, and with the die parts away from the cylinder being broken away;

FIG. II is a vertical sectional view of a closed die casting die for a pair of cylinders in relatively vertical movable die parts with separate mandrels for each cylinder according to another embodiment of this invention and a pair of interfitting dowels for supporting the mandrels whose outwardly extending flanges support a common expendable core for the jacket around each cylinder, and with the die parts away from the cylinders being broken away;

FIG. III is a horizontal section of a closed die for another embodiment similar to those shown in FIGS. I and II, but including a second mandrel frame integral for both cylinders and between the mandrels of each cylinder and on the dowels for each cylinder, which mandrel frame holds the printout portion of the expendable core between said mandrels;

FIG. IV is a top view of a V-8 cylinder engine block in a side elevational view of an open die casting die with its mandrels and core removed and with the die parts away from the block being broken away; and FIG. V is an enlarged horizontal sectional view taken along line V—V of the closed die parts on the casting shown in FIG. IV, showing a retractable dowel in a mandrel in the cylinder at the left and at the right two retractable head bolt-hole pins between cylinders in the block and with the die parts away from the block being broken away.

DETAILED DESCRIPTION OF THE PREFERRED EMBODIMENTS

Figure 1:
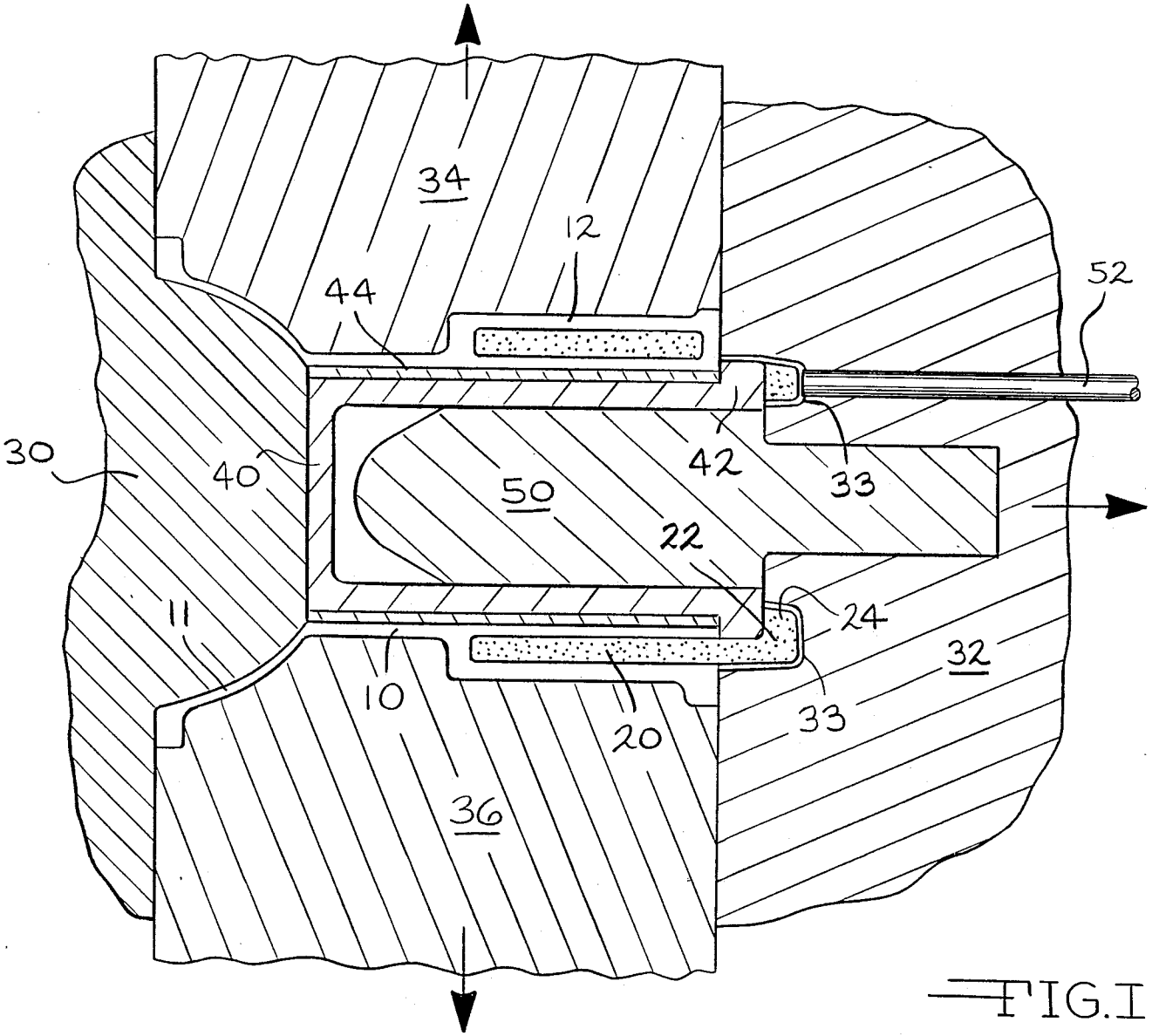

Referring first to FIG. I there is shown in vertical section of one or more aligned cylinders for an engine block in a horizontal parting die casting die, which cylinder space 10 adjoins a crankcase space 11 at its lower end and a water jacket 12 around the cylinder provided by an expendable core 20, which core 20 has a printout portion 22 at its upper end having an inwardly extending flange 24.

The die parts for forming this cylinder comprise a stationary or fixed die 30 and opposite it a horizontal movable or ejector die 32, and two orthogonally oppositely vertically movable slides 34 and 36, respectively, which form two sides of the cylinder block with its jacket.

Inside the cylinder is a hollow mandrel 40 having an outwardly extending flange 42 at its one end for supporting the expendable core 20 by engagement with its printout portion flange 24. Around the outside of this mandrel may be provided a liner 44 which is molded into the inside of the cylinder in space 10. Inside the hollow mandrel 40 is a dowel 50, which in this embodiment is anchored to the ejector die 32. The mandrel 40, when the die is closed, is clamped between the fixed or cover die 30 at its one end adjacent the crankcase, and by the ejector die 32 at its other end adjacent the flange 42. Although the mandrel 42 is a separate piece usually of special tool steel like the dies, it is removable from its liner 44 and the dowel 50 after the cylinder block has been formed.

In the ejector die 32 there is provided a printout cavity 33 for the printout portion 22 of the expendable core 20, which printout cavity 33 may be slightly larger than the printout portion 22 so as to provide a space or a gap between it and the printout portion 22 of the core, so that the core 20 will float and will not be broken by closing of the die parts. However there preferably also is provided a plurality of locating pins 52 in the ejector die 32 which bridge part of the gap between the core printout portion 22 and the printout cavity 33 to locate more accurately the core 20 in the die. A more detailed showing of these locating pins are disclosed in the above mentioned Koch U.S. Pat. No. 4,913,217. Preferably at least two of these pins 52 are located around each cylinder, plus an additional pin 52 at the end cylinders in an aligned row of cylinders.

Thus in preparing an expendable core 20 for a cylinder block die casting die, when the die is open, the core 20 may be placed over the mandrel 40 before the mandrel 40 is placed over the dowel 50, or the core 20 may be placed in the die before the mandrel is placed on the dowel 50. Then the die is closed and the molten metal is introduced, poured or injected under pressure into the die to fill the spaces 10 and 11 to form a cylinder block. Next the die is opened and the cylinder block is removed together with the core 20 and the mandrel 40; the core having its resinous binder, for sand grains forming the base of the core, already deteriorated or decomposed, and the core has disintegrated into particles due to the heat of the molten metal so that the core breaks up or crumbles and thus it can be shaken out of the cast block easily. The mandrel is removed from the die cast block and prepared for use in the next cylinder block.

Referring now to the embodiment shown in FIG. II, it is a vertical section of relatively vertical partable dies 70 and 72 in closed position for forming an engine block having a pair of cylinders in the spaces 60 and 62 with a surrounding jacket formed by an expendable core 64 with its inwardly flanged printout sections 65, 66, and 67. Since this is a vertically-operating pair of cover and ejector dies 70 and 72, respectively, there are provided a pair of telescopically interfitting dowels in each cylinder, namely inner dowels 74 attached to the cover die 70 and outer dowel 76 attached to the ejector die 72. The outer ends of these dowels 74 and 76 when closed fit inside and around the socket portion 82 inside the mandrels 80. These mandrels 80 support the liners 84 for the two cylinders 60 and 62 and their outwardly flanged ends 86 support the inwardly extending flange portions of the printout portions 65, 66 and 67 of the expendable core 64. Similarly as in FIG. I the printout cavities 78 in the die 72 may be larger than the printout portions of the core 64 to provide a gap which is partially bridged by a plurality of spaced locating pins 79.

In assembling the core and mandrels of this embodiment in FIG. II, since they would fall off the dowels 76 in the upper ejector die 72, the mandrels 80 are placed on the dowels 74 in the lower or fixed cover die part 70 before the die is closed. The core 64 may be placed on the mandrels 80 either before or after the mandrels 80 are placed on the dowels 74. Similarly, after the block is cast, the die casting is removed with the disintegrated core and mandrels 80 and then the core and mandrels are separated from the casting so the mandrels 80 can be used for producing the next block.

Referring now to FIG. III, there is shown a further embodiment of the die parts and mandrels according to this invention for a two-cylinder engine block in which an additional unitary mandrel frame 100 is employed for supporting the separete cup-shaped mandrels 90, which mandrel frame 100 connects the cylinders together by a bridge 102, as well as supporting the expendable core 110. This additional mandrel frame 100 also has an outwardly extending flange 103 which together with the outwardly extending flange 92 on the mandrels 90 surround the inwardly extending flanges 111, 112 and 113 on the printout portions of the expendable core 110. The bridging or mandrel frame 100 is supported on the dowels 106 mounted on the ejector die 108 and both mandrels 90 and mandrel frame 100 are clamped between the cover or fixed die 98 and the ejector die 108. The separate cup-shaped mandrels 90 carry the cylinder liners 94. There are also shown the two retractable slides 96 and 97 for the sides of the cylinders. As in the previous embodiments, the unitary expendable core 110 may have a gap around its printout portions and flanges 103 of the mandrel frame 100, which gap is partly bridged by locating pins, such as pin 109.

Thus in the assembly of the mandrels 90 and mandrel frame 100 and the expendable core 110 for this embodiment, the core 110 may either be assembled outside the die or on the dowels 106 in the die 108. In either case, the core 110 is always the second of the three different type parts assembled, since the flanges 111, 112, and 113 of the core printout portion are fitted between the flanges 92 and 103 of the mandrels 90 and mandrel frame 100, respectively. Similarly, after the engine block is formed in the die, both the mandrel frame 100 and mandrels 90 are removed with the block and the disintegrated core, and then the mandrels 90 and mandrel frame 100 are separated from the cast block and each other to be used again with another core 110.

Referring finally to FIGS. IV and V, there is shown in FIG. IV a V8-cylinder engine block 120 on end in a die casting die showing the possible slides 122, 124, 126, and 128 in a vertical plane, which slides may be employed in forming the sides and ends of the block 120. However, one or both of the end slides 126 and/or 128 may not be necessary depending upon the configuration of the ends of the block 120. Not shown in FIG. IV are the cover and ejector dies for the crankcase and top sides of the cylinders, respectively.

Referring now to the horizontal section shown in FIG. V there are shown the cover die 130 and ejector die 132, the former of which forms the inside of the crankcase housing 121 of the block 120 and the latter of which forms the upper side of both rows of V8-cylinders and supports the retractable dowels 140 for each cylinder and the retractable pins 142 for the bolts for anchoring the heads onto the cylinder blocks.

At the left side of FIG. V there is shown one of the eight mandrels 150 having an outwardly extending flange 152 and carrying the cylinder liner 154. The outwardly extending flanges 152 of the mandrel 150 also support the inwardly extending flanges 162 of printout portions 161 of the expendable core 160 for forming the undercut water jacket around the cylinders. Locating pins (not shown) also may be employed in the ejector die 132 for bridging the gap between the printout cavities in the die 132 and the printout portions 161 of the expendable core 160.

In preparing the die for making the V-engine block, the mandrels 150 and expendable core can be assembled as described for the core and mandrel in FIG. I above, with the die open and the dowels 140 extended as shown in FIG. V. The die is then closed and the hot metal is injected into it to form the V-8 engine block. When the block is formed, the dowels 140 and pins 142 are retracted and then the die is opened and the block, disintegrated core, and mandrels are removed from the die. Then the core and mandrels are removed from the block and the mandrels are used again with another core for forming the next V-8 engine block in the die.

Although various different shapes and sizes of mandrels, dowels, and expendable cores are shown to be employed in the different embodiments of this invention, it is to be clearly understood that they may be interchanged and used in different shapes for casting different types of cylinders with jackets around them. The cylinders may be other than circular i.e. hollow objects of non-circular cross-section, such as ovals, polygons, etc. Also the additional mandrel frame 100 shown in FIG. III may be employed in any engine block, including a V-engine block, for cylinders that have their axes parallel and in a common plane, without departing from the scope of this invention.

The expendable core is preferably made of sand bound together by an organic resin which decomposes after the hot metal poured or injected into the die around the core has solidified.

While there is described above the principles of this invention in connection with specific apparatus, it is to be clearly understood that this description is made only by way of example and not as a limitation to the scope of this invention.

We claim:

1. A casting die for a cylinder comprising:

(A) a die for forming an end of a cylinder, (B) a dowel mounted on said die coaxial of said cylinder, (C) a hollow cylindrical mandrel removably supported on said dowel, said mandrel having an outwardly extending peripheral flange at one end of said mandrel, and (D) an expendable core around said mandrel and spaced therefrom, said core having a printout portion cooperating with said flange on said mandrel for holding said core in position.

2. A die according to claim 1 wherein said dowel is fixedly mounted in said die.

3. A die according to claim 1 wherein said dowel is axially retractable from said cylinder in said die.

4. A die according to claim 1 including a cylindrical liner for the cylinder, said liner being supported by said mandrel.

5. A casting die for a block of a plurality of cylinders formed in a mold, said mold comprising:

(A) a die for forming one end of said cylinders, (B) a plurality of dowels mounted on said die coaxial with each of said cylinders, (C) a plurality of hollow cylindrical mandrels removably supported on each of said dowels, each said mandrel having an outwardly extending peripheral flange at one end of said mandrel, and (D) an expendable core around said mandrels and spaced therefrom, said core having printout portions cooperating with said flanges on each of said mandrels for holding said core in position.

6. A casting die according to claim 5 wherein said dowels are fixedly mounted in said die.

7. A casting die according to claim 5 wherein said dowels are axially retractable from said cylinders in said die.

8. A casting die according to claim 5 including a plurality of cylindrical liners, one for each of said cylinders, said liners being supported by said mandrels.

9. A casting die according to claim 5 including a second mandrel between said madrels and said dowels on at least two adjacent cylinders for connecting together the mandrels for said adjacent cylinders.

10. A partable casting die having at least four parts for a V-block of a plurality of cylinders and a housing comprising:

(A) a first die part for forming the inside of said housing, (B) a second die part for the outside half of said cylinders opposite said first die part, (C) two opposite side separable parting dies for the outside of said housing and the other outside half of said cylinders, (D) retractable dowels axially of each of said cylinders in at least one of said die parts, (E) removable mandrels for forming the inside of said cylinders supported by said dowels, and (F) an expendable core supported by said mandrels for forming the cooling passages around said cylinders.

11. A die according to claim 10 wherein said mandrels have peripheral flanges at one end thereof, and said core has a printout portion held by said flanges for positioning said core around said cylinders.

12. A die according to claim 10 including cylinder liners mounted on said mandrels.

13. A die according to claim 10 including a second mandrel between said mandrels and said dowels on at least two adjacent cylinders for connecting together the mandrels for said adjacent cylinders.

14. A method for producing cast cylinder blocks with undercut jackets around the cylinders comprising: separable die parts, an expendable core for said jacket, mandrels for the inside of said cylinders, and dowels in a die part for mounting said mandrels, the steps comprising:

(A) assembling said mandrels and cores;

(B) placing said mandrel and core on said dowel;

(C) clamping said mandrel between opposing die parts;

(D) introducing molten metal into said die around said mandrel and said core;

(E) permitting said molten metal to solidify in said die;

(F) removing said solid casting block with said mandrel and core; and (G) separating said core and said mandrel from said casting.

15. A method according to claim 14 including a second mandrel frame, and assembling said core between said mandrel and said mandrel frame before placing this assembly on said dowels.

* * * * *